United States Patent [19]

Pardes

[11] Patent Number: 4,898,306

[45] Date of Patent: Feb. 6, 1990

[54] COLLAPSIBLE CONTAINER FOR FLOWABLE SUBSTANCES

[75] Inventor: Greg Pardes, New York, N.Y.

[73] Assignee: Reseal International Limited Partnership

[21] Appl. No.: 143,823

[22] Filed: Jan. 13, 1988

[51] Int. Cl.[4] ..... B65D 37/00

[52] U.S. Cl. ..... 222/206; 222/215

[58] Field of Search ..... 222/206, 207, 209, 210, 222/212–213, 215; 401/138–184; 215/1 C

[56] References Cited

U.S. PATENT DOCUMENTS

| | | | |
|---|---|---|---|
| 3,179,301 | 4/1965 | Lucht | 222/213 |
| 3,494,509 | 2/1970 | Maguire | 222/107 |
| 3,506,163 | 4/1970 | Rauh et al. | 222/212 |
| 3,727,803 | 4/1973 | Cobb | 222/215 |
| 3,833,154 | 9/1974 | Markowitz | 222/212 |
| 4,217,994 | 8/1980 | Koenig et al. | 222/212 |

FOREIGN PATENT DOCUMENTS

| | | | |
|---|---|---|---|
| 44760 | 6/1908 | Switzerland | 222/214 |
| 798338 | 7/1958 | United Kingdom | 222/215 |

*Primary Examiner*—Michael S. Huppert

*Attorney, Agent, or Firm*—Toren, McGeady & Associates

[57] ABSTRACT

A collapsible container for dispensing a flowable substance includes a pair of generally rigid walls interconnected by bellows-like walls and a web. The container can be arranged in the expanded condition with the rigid wall spaced apart from one another and in the collapsible condition with the rigid walls disposed in generally parallel relation forming a flattened unit. The rigid walls provide an effective labelling surface for the container.

7 Claims, 2 Drawing Sheets

COLLAPSIBLE CONTAINER FOR FLOWABLE SUBSTANCES

BACKGROUND OF THE INVENTION

The present invention is directed to a collapsible container for dispensing a flowable substance.

In U.S. Pat. No. 3,506,163 to Rauh, et al., a collapsible container is disclosed for dispensing a variety of materials ranging from toilet articles to food stuffs. The material may be highly viscous, though a liquid or fluid substance can be dispensed.

In U.S. Pat. No. 3,494,509 to McGuire, a variable volume reservoir is disclosed having a principal use in fuel supply systems. The container is made up of a pair of spaced panels interconnected by a bellows-like structure so that the panels move toward one another as the reservoir collapses.

One of the problems faced in packaging has been to provide a collapsible container from which the contents can be completely dispensed while providing effective labelling surfaces. In the packaging of flowable substances, providing a container which can be efficiently shipped and stored provides a difficult task. Flexible containers usually are not collapsible, or if they are, it is difficult to return them to the condition for filling with the substance to be dispensed. Generally, the containers have been of a rounded or arcuate cross section. In shipment, such containers require considerable space and can be shipped economically only over relatively short distances. For the same reason that shipping provides a problem, storage of the containers is also, difficult.

Depending on the substance to be dispensed, it may be important to maintain the container contents in a sterile condition. Moreover, if the contents are relatively expensive, the capability of dispensing the entire contents is significant.

SUMMARY OF THE INVENTION

Therefore, it is the primary object of the present invention to provide a container for dispensing flowable substances which can be collapsed for affording economic shipment and storage. Furthermore, the container provides surfaces which can be effectively and efficiently labelled.

In accordance with the present invention, a container is formed of a pair of generally rigid walls interconnected by collapsible walls. The collapsible walls can be arranged in an extended condition when the container is filled and into a collapsed condition when the container contents are completely dispensed.

In one embodiment, the collapsible walls form a base with the rigid walls projecting upwardly from the base. To ship the containers, the rigid walls are displaced toward one another so that the container forms a generally flat collapsed unit. The container has an opening through which it can be filled and from which the material can be dispensed. The rigid walls can be planar or provided with a gradually curved configuration. The surface of the rigid walls provides an excellent base for labelling.

When the container is filled, the base has its maximum area and, as the material is dispensed, the area of the base becomes smaller. The rigid walls provide stability so that as the material in the container is dispensed, the base continues to form an adequate support.

During shipment, the collapsed container can be shipped taking up a minimum volume. This feature assures not only economical shipping, but also storage of the containers until they are ready to be used.

The containers can be provided in a variety of shapes so that in the filled condition, they can be stored in a compact manner without any wasted space. Accordingly, in the collapsed or filled condition, the containers can be effectively packaged.

In the collapsed or expanded condition, the container has at least one fixed dimension. Depending on the shape of the container, when expanded, it can have two fixed dimensions.

In one preferred embodiment of the container in the expanded condition, the cross-section of the container transversely of its height or parallel with its base is generally triangular. The collapsible walls located between the two rigid walls collapse in a bellows-like manner so that in the collapsed condition, the base is flattened, forming a narrow rectangular shape.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 4:
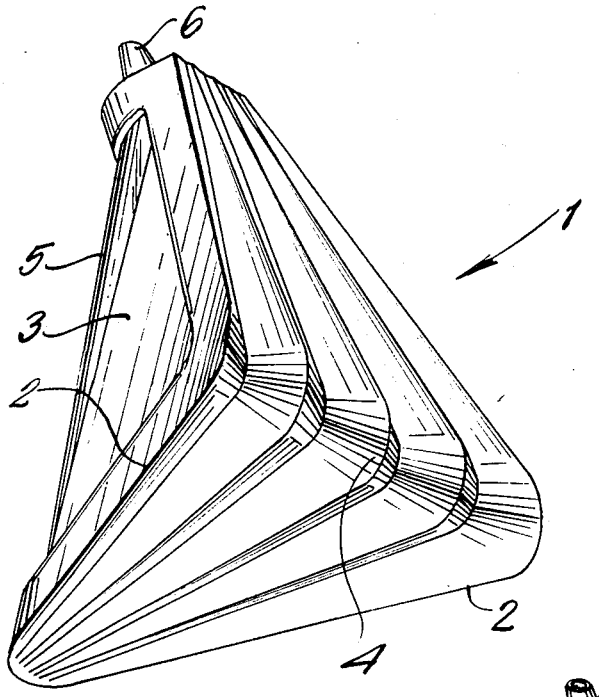
FIG. 4 is a perspective view of the container taken generally in the same direction as FIG. 2.
Figure 5:
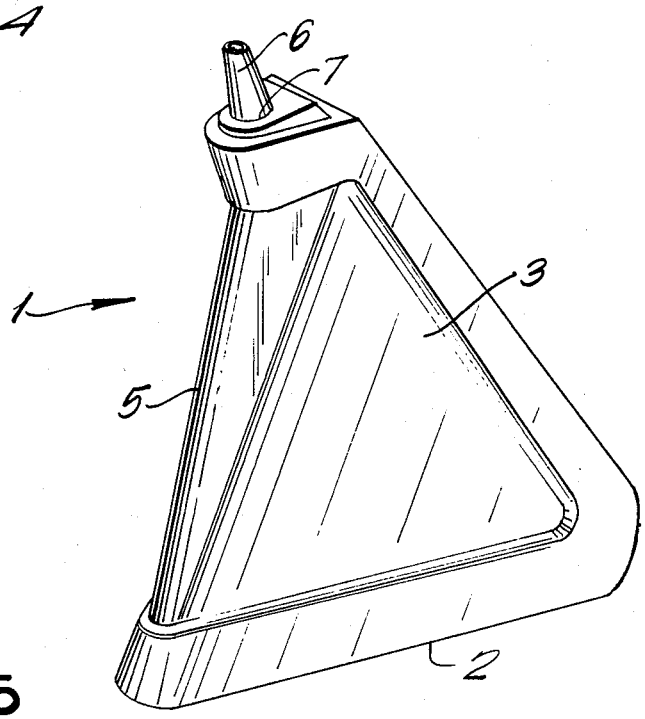
FIG. 5 is a perspective view of the container taken in the opposite direction to FIG. 2.

In the drawing, a collapsible container 1 is shown. The container has a base 2 for supporting it when placed on a support surface. The container is formed of a pair of substantially rigid planar side walls 3, interconnected at the base and along the height of the side walls by collapsible walls 4. The side walls 3 are joined along corresponding edges by a connecting web 5. Note the perspective views in FIGS. 4 and 5.

Figure 1:
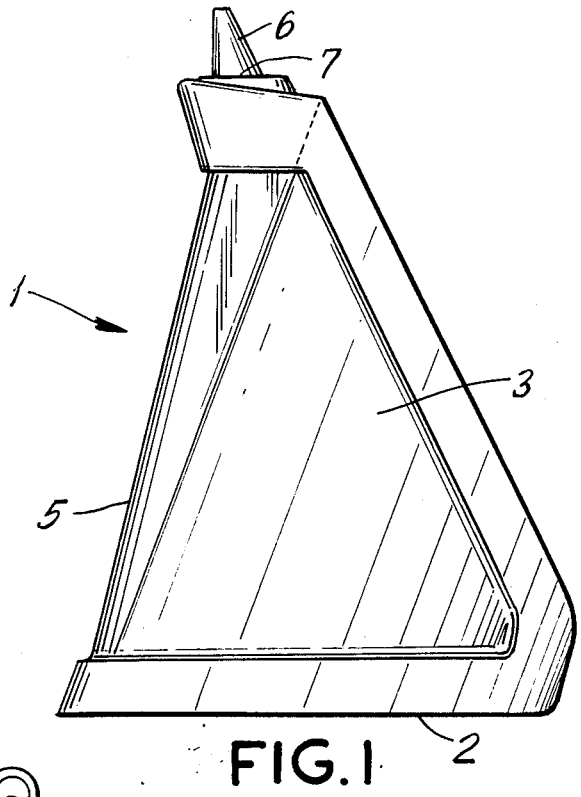
FIG. 1 is an elevational view of a container embodying the present invention.
Figure 2:
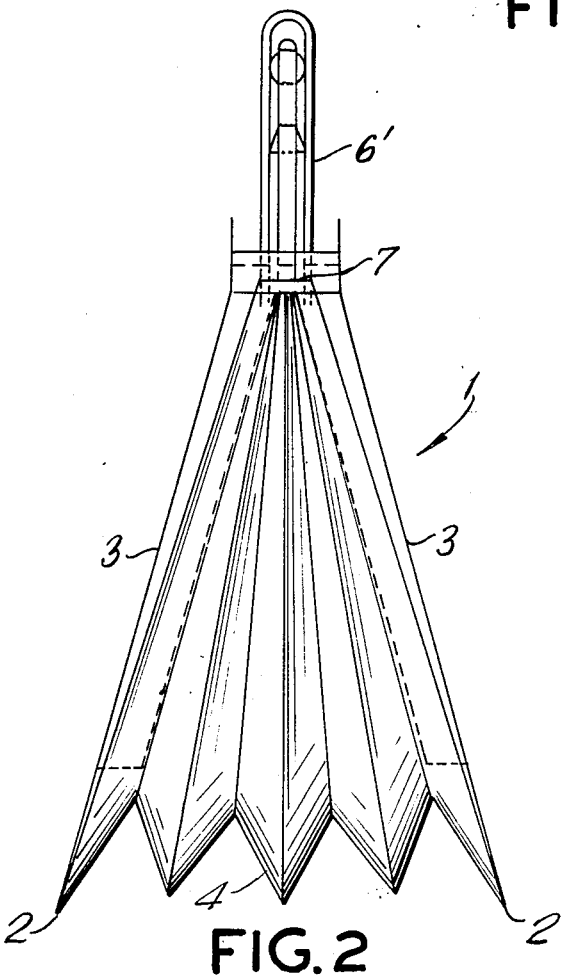
FIG. 2 is an elevational view of the container shown in FIG. 1, rotated through 90°, and with a dispensing spout.
Figure 3:
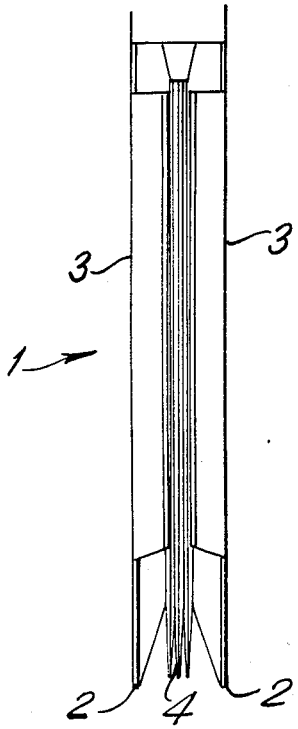
FIG. 3 is a view similar to FIG. 2, however, illustrating the container in the flattened collapsed condition and without the dispensing spout.

In FIG. 1, a spout 6 is shown schematically and an alternate arrangement of the spout 6′ is shown in FIG. 2. In FIG. 3, the spout is removed. The container can be in the expanded condition shown in FIG. 2, or in the collapsed flattened condition, as shown in FIG. 3. An opening 7 is located in the top of the container for filling it with a flowable substance and when a spout is attached for forming a dispensing outlet from the container.

To dispense the contents the rigid side walls 3 are pressed toward one another and the contents flow out through the spout 6. Depending on the type of material being dispensed, the spout may provide a seal which permits outflow of the contents without any inflow of air when the dispensing operation is completed.

For the dispensation of sterile substances, a valve such as set forth in U.S. patent application 072,534 filed July 13, 1987 by Gerber, can be used.

The surfaces of the walls 3 are planar or flat, however, it would be possible to provide the walls with a generally flattened curvature for receiving labels or the like.

Generally speaking, the side walls are interconnected by the web 5 so that they can pivot relative to one another from the expanded condition shown in FIG. 2 to the collapsed or flattened condition in FIG. 3. The location of the web long the height or at the top of the walls depends on the desired configuration of the container.

The container can be formed of a variety of plastics materials such as polyethylene.

The collapsible walls 4 have a bellow-like shape and extend between and interconnect the walls 3. The collapsible walls 4, relative to the dispensing spout, afford an arrangement permitting complete dispensation of all of the substance within the container.

In FIG. 2, in its expanded condition, the bellow-like walls defining the bottom of the container are arranged so that the adjacent surfaces within the container are in divergent relationship. When the container is empty either before or after it is filled, the rigid walls pivot inwardly toward one another from the position shown in FIG. 2 into the completely flattened condition shown in FIG. 3. In FIG. 3, the bottom portion of the walls 4 are shown collapsed into the flattened condition shown between the rigid walls 3.

The container can be formed in a blow-molding operation without the dispensing spout so that the container can, in the completely flattened condition, be packed in boxes and shipped any required distance. When the containers are ready to be used, they can be filled with a flowable substance and the dispensing spout 6, 6' attached. A person skilled in the art would readily appreciate that the over-all configuration of the container can be varied both for functional and aesthetic reasons.

While specific embodiments of the invention have been shown and described in detail to illustrate the application of the inventive principles, it will be understood that the invention may be embodied otherwise without departing from such principles.

I claim:

1. A container for dispensing flowable substances and being displaceable between an expanded condition and a collapsed condition comprising wall means forming an enclosed space for holding the flowable substance, said wall means including a pair of generally rigid walls having bordering edges, collapsible walls interconnecting a part of said bordering edges of said rigid walls, and a web connecting the remainder of said bordering edges of said rigid walls, in the expanded condition of said container said rigid walls being in gradually diverging relationship extending from said web in the expanded condition of said container and said web affording pivotable movement of said rigid walls for placing said container in the collapsed condition, said collapsible walls being displaceable between the expanded condition and the collapsed condition, and in the collapsed condition said rigid walls are disposed adjacent to one another around said bordering edges and said container being in a flattened shape, and a part of said collapsible walls forming a base for said container with said rigid walls and said web extending upwardly from the base.

2. A container, as set forth in claim 1, wherein said rigid walls are planar and have a generally triangular shape with one of the bordering edges of each of said rigid walls extending along the base of said container, and another bordering edge of each of said rigid walls connected to said web.

3. A container, as set forth in claim 1, wherein said collapsible walls have a bellows-like configuration.

4. A container, as set forth in claim 1, wherein said container has an opening for filling the flowable substance into the container and for dispensing the flowable substance, and a dispensing spout removably attachable to said opening.

5. A container, as set forth in claim 1, wherein said web extends upwardly from said base to an upper end of each of said rigid walls.

6. A dispenser for flowable substances including a container with an outlet for the flowable substance, said container being collapsible and expandable between a flattened condition and an expanded condition, said container including a pair of rigid side walls, means interconnecting said rigid side walls for movement between the expanded and collapsed conditions, said means including a base for supporting said dispenser on a surface with said rigid side walls extending upwardly from the base in the supported condition and a web extending upwardly from said base and pivotally interconnecting a side of each of said rigid walls, said rigid side walls extending in gradually diverging relation away from said web in the expanded condition so that said rigid walls pivot toward one another from the expanded condition to the flattened condition.

7. A container for dispensing flowable substances comprising a base, a pair of generally rigid walls extending transversely of said base, wall means forming said base and interconnecting said rigid walls and, in combination therewith, forming an enclosed space for the substance to be dispensed, said wall means being displaceable between a collapsed condition and an expanded condition with said rigid walls being in generally parallel relation in the collapsed condition, said wall means including a web extending upwardly from said base and attaching said rigid walls so that said rigid walls can pivot relative to one another between the collapsed and expanded condition, and said rigid walls being in diverging relation in the expanded condition.

* * * * *